US009488928B2

(12) United States Patent
Azeta

(10) Patent No.: US 9,488,928 B2
(45) Date of Patent: Nov. 8, 2016

(54) IMAGE FORMING APPARATUS WITH GUIDE FOR EXPOSURE UNIT

(71) Applicant: CANON KABUSHIKI KAISHA, Tokyo (JP)

(72) Inventor: Takahiro Azeta, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/839,150

(22) Filed: Aug. 28, 2015

(65) Prior Publication Data

US 2016/0062262 A1 Mar. 3, 2016

(30) Foreign Application Priority Data

Sep. 3, 2014 (JP) ..... 2014-179049
Jul. 23, 2015 (JP) ..... 2015-146166

(51) Int. Cl.
*G03G 15/04* (2006.01)
*G03G 15/01* (2006.01)
*G03G 21/16* (2006.01)

(52) U.S. Cl.
CPC ..... *G03G 15/04054* (2013.01); *G03G 15/011* (2013.01); *G03G 21/1666* (2013.01); *G03G 2215/0409* (2013.01); *G03G 2221/1636* (2013.01)

(58) Field of Classification Search
CPC ..... G03G 15/04036; G03G 15/011; G03G 15/04054; G03G 21/1633; G03G 21/1666; G03G 21/1842; G03G 2215/0103; G03G 2215/0409; G03G 2221/1636; G03G 2221/1807; G03G 2221/1684; G03G 2221/1687; B41J 2/45
USPC ..... 399/4, 118; 347/117, 138, 152, 238, 347/242, 245, 257, 263
See application file for complete search history.

(56) References Cited

U.S. PATENT DOCUMENTS 8,238,764 B2 8/2012 Funahashi
8,918,014 B2 * 12/2014 Yoshimura ..... G03G 21/1821 399/113
9,146,492 B2 * 9/2015 Suzuki ..... G03G 21/1821
2003/0160856 A1 * 8/2003 Araki ..... G03G 21/1633 347/138
2007/0115340 A1 * 5/2007 Tanabe ..... B41J 2/45 347/130
2009/0269101 A1 * 10/2009 Okabe ..... G03G 15/0131 399/114
2011/0299873 A1 * 12/2011 Ushiozu ..... G03G 15/04054 399/90
2011/0299883 A1 * 12/2011 Suzuki ..... G03G 15/0894 399/110
2012/0183321 A1 * 7/2012 Mori ..... G03G 21/1633 399/110
2012/0183324 A1 * 7/2012 Sato ..... G03G 15/0194 399/110
2013/0164027 A1 * 6/2013 Sato ..... G03G 21/1633 399/110

(Continued)

FOREIGN PATENT DOCUMENTS

JP 07-104637 A 4/1995
JP 2009-210613 A 9/2009

*Primary Examiner* — Robert Beatty
(74) *Attorney, Agent, or Firm* — Fitzpatrick, Cella, Harper & Scinto

(57) ABSTRACT

The image forming apparatus has: a photoreceptor; an exposure unit that exposes the photoreceptor to light; a first contact portion; and a positioning portion provided in the exposure unit, this portion coming into contact with the first contact portion to position the exposure unit in a first position where the photoreceptor is exposed to light. The image forming apparatus also has: a second contact portion; and a contacted portion provided in the exposure unit, wherein the contacted portion is brought into contact with the second contact portion, thereby positioning the exposure unit in a second position where the positioning portion and the first contact portion are separated from each other.

17 Claims, 19 Drawing Sheets

(56) References Cited

U.S. PATENT DOCUMENTS

2013/0308983 A1* 11/2013 Takano ..... G03G 15/757
399/205

2015/0331386 A1* 11/2015 Tanaami ..... G03G 21/1666
399/110

* cited by examiner

IMAGE FORMING APPARATUS WITH GUIDE FOR EXPOSURE UNIT

BACKGROUND OF THE INVENTION

1. Field of the Invention

The present invention relates to an image forming apparatus.

2. Description of the Related Art

Laser scanning systems and LED exposure systems have been popularized as the image writing systems (exposure systems) among the conventional image forming apparatuses such as copying machines and printers. LED exposure system is a system for forming a latent image on the surface of a photosensitive drum by exposing, using the imaging means, the surface of the photoreceptor to light emitted from an exposure device having a plurality of light-emitting elements lined up along the axial direction of the photosensitive drum. For the reason of the light intensity, the LED exposure system needs to have the exposure device placed close to the photosensitive drum, requiring high precision in the positional relation between the exposure device and the photosensitive drum.

In light of this fact, there has been known a configuration in which an LED unit is provided with a positioning portion (a roller), which is brought into contact with a predetermined contact portion to keep the distance between the LED head (exposure unit) of the LED unit and the photosensitive drum constant at the time of image formation (see Japanese Patent Application Laid-open No. 2009-210613). There is also known a method for packaging the process cartridges in an image forming apparatus main body to transport the image forming apparatus along with the process cartridges (see Japanese Patent Application Laid-open No. H7-104637).

When transporting an image forming apparatus in which a positioning portion for positioning an LED head (an exposure unit) in relation to a photosensitive drum (a photoreceptor) is in contact with a predetermined contact portion, the surface of the positioning portion or the predetermined contact portion could be damaged by, for example, vibration of the transportation. The damaged surface of the positioning portion could inhibit accurate positioning of the LED head with respect to the photosensitive drum at the time of image formation and therefore affect the image formation.

In view of the foregoing problems, an object of the present invention is to prevent damage to the positioning portion for positioning the exposure unit with respect to the photoreceptor at the time of image formation or to the predetermined contact portion.

SUMMARY OF THE INVENTION

An objection of the present invention is to provide an image forming apparatus, comprising:

a photoreceptor;

an exposure unit that exposes the photoreceptor to light;

a first contact portion;

a positioning portion provided in the exposure unit, this portion coming into contact with the first contact portion to position the exposure unit in a first position where the photoreceptor is exposed to light;

a second contact portion; and a contacted portion that is provided in the exposure unit, wherein the contacted portion is brought into contact with the second contact portion, thereby positioning the exposure unit in a second position where the positioning portion and the first contact portion are separated from each other.

Further features of the present invention will become apparent from the following description of exemplary embodiments with reference to the attached drawings.

DESCRIPTION OF THE EMBODIMENTS

Embodiments for implementing the present invention are now exemplarily described hereinafter in detail based on the examples and with reference to the drawings. However, the sizes, materials, shapes and relative positions of the components described in the embodiments can be changed in accordance with the configurations of the apparatus and various conditions to which the present invention is applied. In other words, the scope of the present invention is not intended to be limited to the following embodiments.

Embodiment 1

Figure 1:
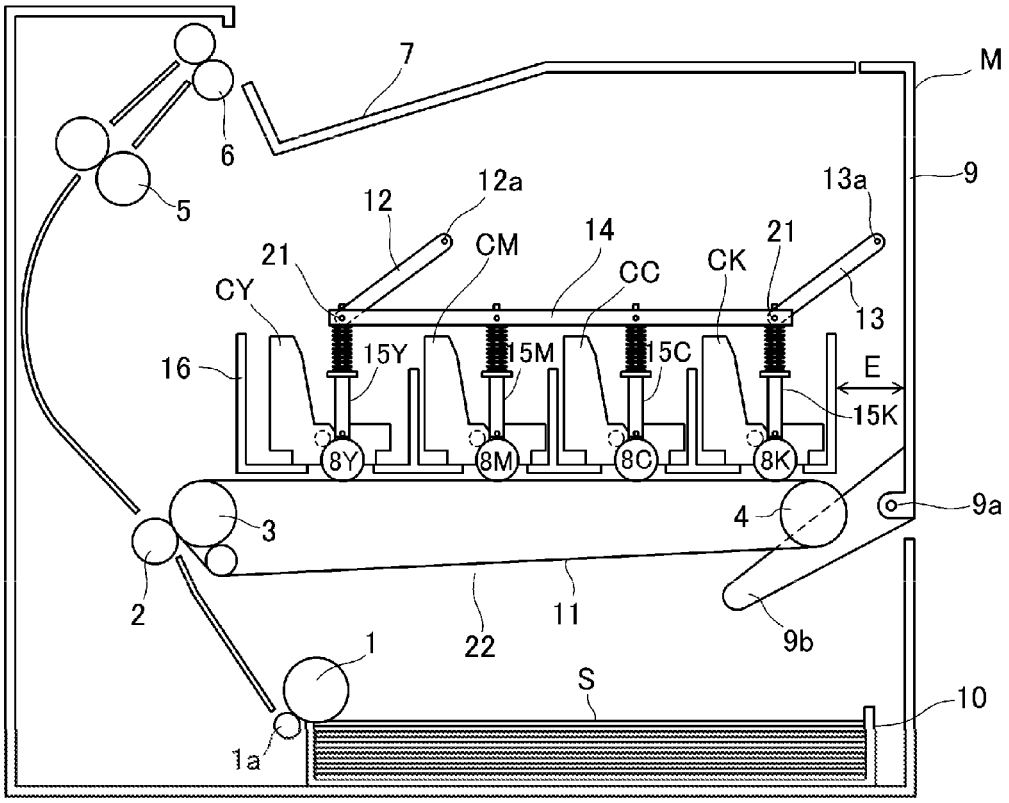
FIG. 1 is a schematic cross-sectional diagram showing the entire configuration of an image forming apparatus according to Embodiment 1.

First of all, the entire schematic configuration of an image forming apparatus according to Embodiment 1 is described with reference to FIG. 1. FIG. 1 is a schematic cross-sectional diagram showing the entire configuration of the image forming apparatus according to Embodiment 1. As an example of the image forming apparatus, Embodiment 1 describes an LED printer with four full colors that employs an electrophotographic image forming process. This printer forms an image on a sheet S (a recording medium) based on an image signal that is input from an external host apparatus (not shown) such as a personal computer or an image reader. In the following description, the front side of a main body of the apparatus M of the image forming apparatus is the side with a door 9 that can be rotated about a point of support 9*a* (the right side of FIG. 1), and the rear side (the far side) is the opposite (the left side of FIG. 1) to the front side.

As shown in FIG. 1, four process cartridges (simply called "cartridge(s)," hereinafter) CY, CM, CC, CK are arranged horizontally from the rear side to the front side in the main body of the apparatus M of the image forming apparatus. The cartridges C have toners of different colors as stored developers but share the same configuration. The cartridges CY, CM, CC, CK respectively have rotatable photosensitive drums 8Y, 8M, 8C, 8K as photoreceptors. Also as shown in FIG. 1, the cartridges CY, CM, CC, CK are stored in a tray 16 that is capable of relative movement with respect to the main body of the apparatus M.

The first cartridge CY accommodates a yellow Y toner in a developing device (developer container), not shown, and forms a yellow toner image on the photosensitive drum 8Y. Similarly, the second cartridge CM accommodates a magenta M toner and forms a magenta toner image. The third cartridge CC accommodates a cyan C toner and forms a cyan toner image. The fourth cartridge CK accommodates a black K toner and forms a black toner image. Note that the subscripts "Y," "M," "C" and "K" that are provided to signify the colors are omitted in the following description, if they are not to be discriminated from one another.

A charging device that functions as processing means acting on the photosensitive drum 8, a developing device with a developing roller and the like, and a cleaning device are disposed around each photosensitive drum 8. The cartridge C is configured by integral assembly of these devices within the cartridge frame body. The photosensitive drum 8 is irradiated with LED light, described hereinafter, thereby forming an electrostatic latent image thereon. The developing device supplies the corresponding toner to the electrostatic latent image, forming a toner image on the photosensitive drum 8 as a developer image.

An LED unit functioning as an exposure unit according to Embodiment 1 is now described with reference to FIGS. 1 to 5. The image forming apparatus of Embodiment 1 is a non-laser printer that exposes the photosensitive drum 8 to light emitted from a light-emitting diode (LED) which is a light-emitting element having a lower light intensity than a laser beam. Four LED units 15Y, 15M, 15C, 15K are located at the corresponding positions on the circumferential surfaces of the photosensitive drums 8Y, 8M, 8C, 8K of the cartridges CY, CM, CC, CK, respectively. The LED unit 15 (15Y, 15M, 15C, 15K) is axially supported by an LED support member 14 in a rotatable manner.

The non-laser type image forming apparatus of Embodiment 1 needs to bring an LED head 17*b* (see FIG. 4, etc.) close to the photosensitive drum 8 provided at the end of each LED unit 15, the LED head 17*b* functioning as an exposure device exposing the photosensitive drum 8 to the light. Such a process requires high precision in the positional relation between each of the LED units 15 and each of the photosensitive drums 8 in order to execute high-precision exposure.

Figure 2:
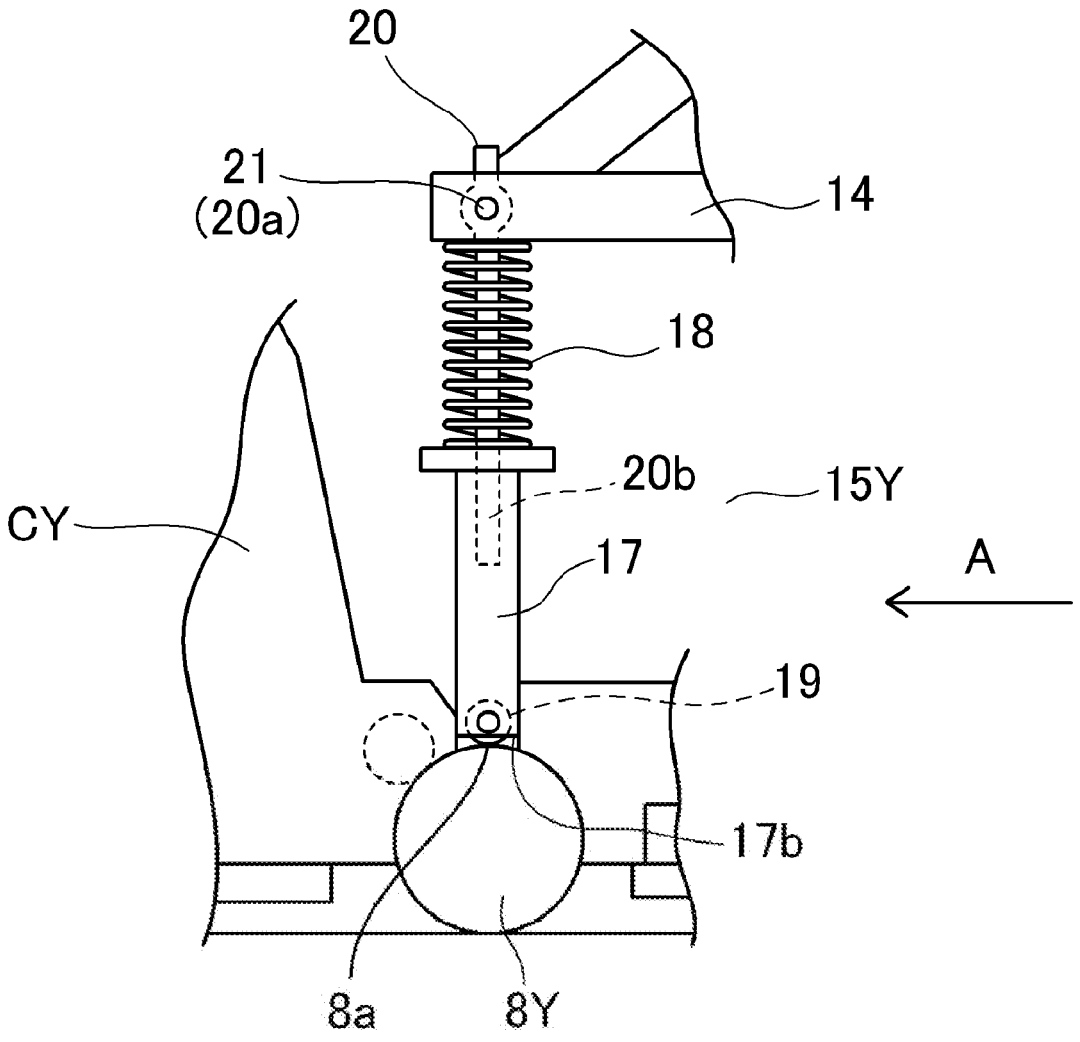
FIG. 2 is an enlarged view showing a state in which a photosensitive drum and an LED head are in contact with each other.
Figure 3:
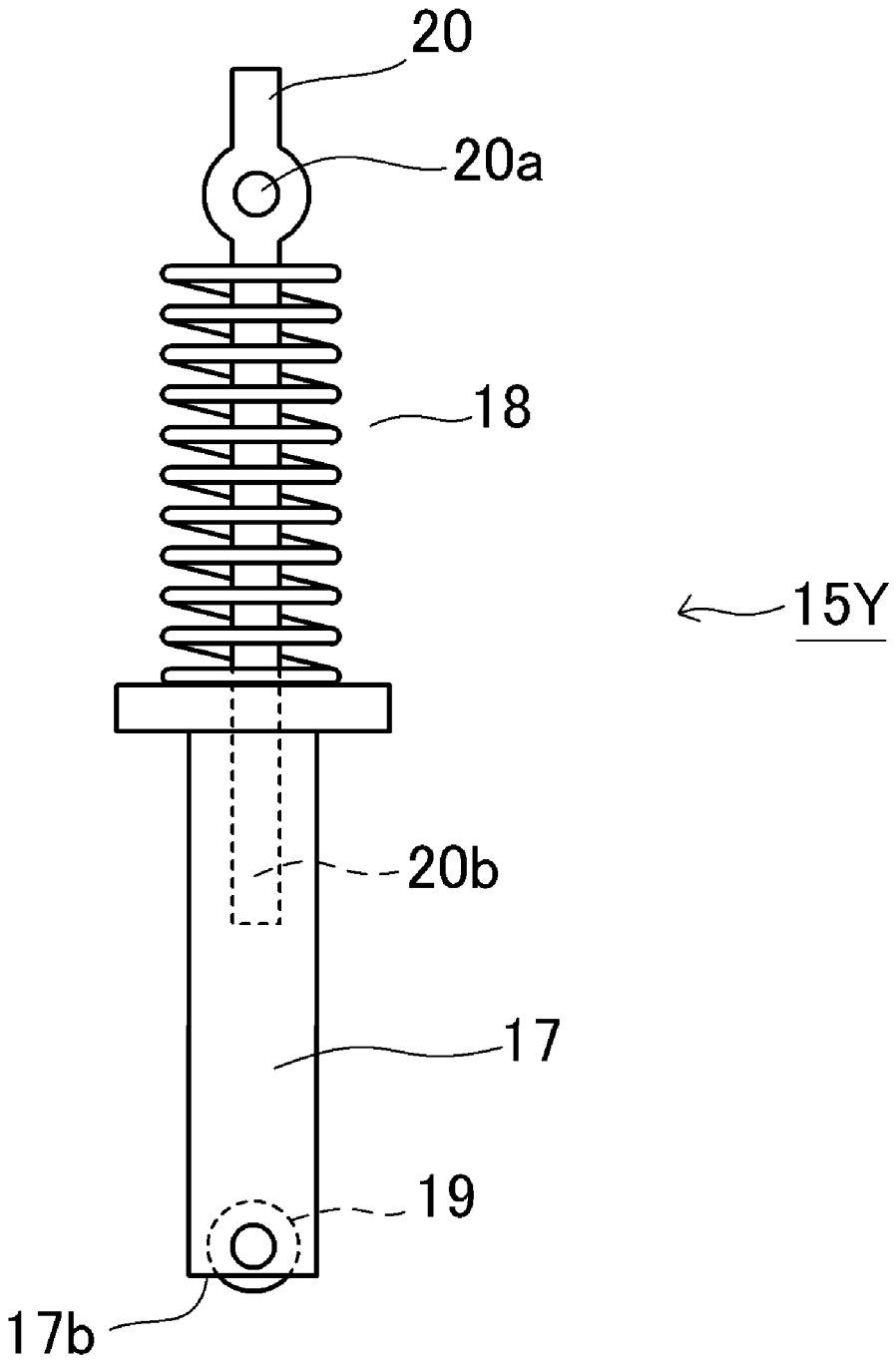
FIG. 3 is a diagram showing the details of a configuration of an LED unit.

FIG. 2 is an enlarged view showing a state in which a photosensitive drum and the LED head of an LED unit are in contact with each other. FIG. 3 is a diagram showing the details of the configuration of one of the LED units. FIGS. 2 and 3 each illustrate only the LED unit 15Y as an example, and note that the LED units 15M, 15C and 15K share the same configuration with the LED unit 15Y.

As shown in FIGS. 2 and 3, the LED unit 15 has the LED head 17*b* functioning as an exposure unit exposing the photosensitive drum 8 to the light, a holding portion 17 retaining the LED head 17*b*, and a rotating member (roller) 19 functioning as a positioning portion. The rotating member 19 positions the LED head 17*b* with respect to the photosensitive drum 8. In the LED head 17*b*, along an axial direction of the photosensitive drum 8 are arranged a plurality of light-emitting diodes, emissions of which are controlled independently. The axial direction of the photosensitive drum 8 is a direction perpendicular to the diagrams shown in FIGS. 2 and 3 and a lateral direction in the diagram shown in FIG. 4.

The main body of the apparatus M has a link member 20 that axially supports the holding portion 17 so as to be rotatable about a shaft 21. The link member 20 has a fitting member 20*b* that is fitted into the holding portion 17, and this fitting of the fitting member 20*b* into the holding portion 17 secures the link member 20 and the holding portion 17 to each other in an unremovable manner. The rotating member 19 is retained rotatably at a lower end of the holding portion 17. This rotating member 19 is brought into pressure-contact with a first contact portion 8*a* of the photosensitive drum 8 by a spring 18 at a longitudinal end of the photosensitive drum 8, and rotates in conjunction with rotation of the photosensitive drum 8. The LED head 17*b* is positioned with respect to the photosensitive drum 8 at the time of image formation, by bringing the rotating member 19 into contact with the first contact portion 8*a* of the photosensitive drum 8 (the distance between the photosensitive drum 8 and the LED head 17*b* is kept constant). In other words, the spring 18 biases the LED head 17*b* in a direction in which the rotating member 19 is pressed against the first contact portion 8*a*, thereby positioning the LED head 17*b* in a first position.

Figure 4:
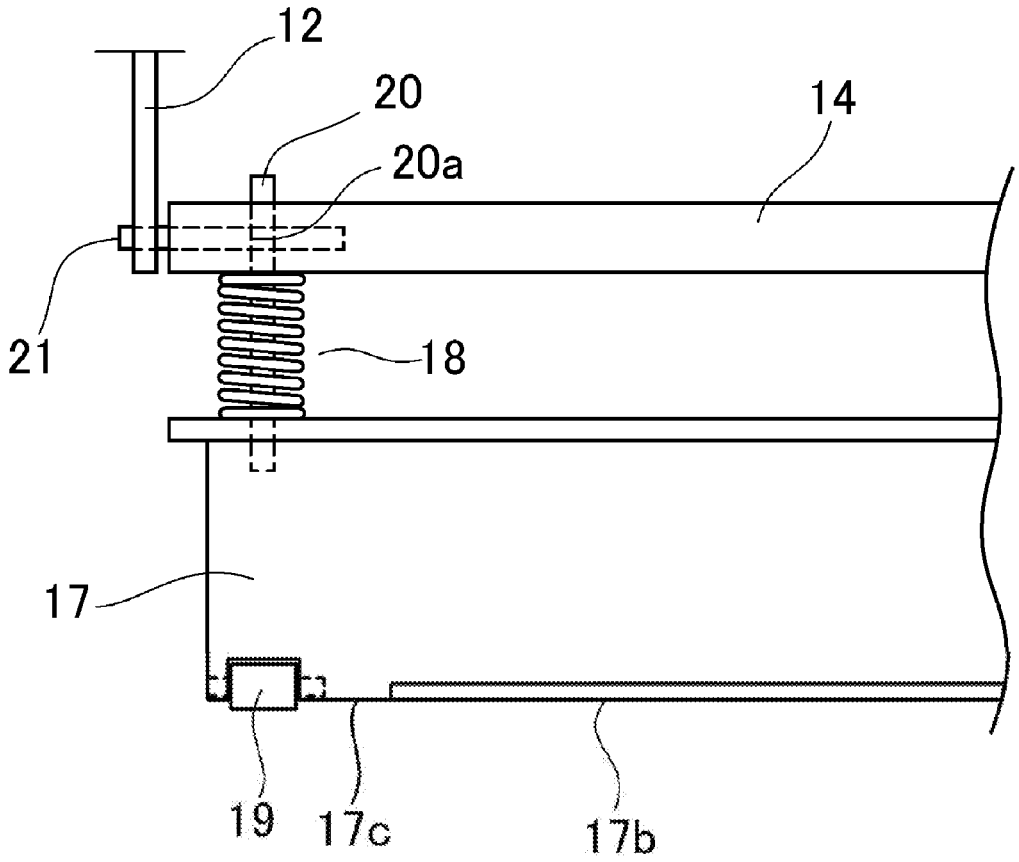
FIG. 4 is a diagram showing the LED unit of FIG. 2 in the direction of the arrow A.

FIG. 4 is a diagram showing the LED unit 15 of FIG. 2 in the direction of the arrow A. As shown in FIG. 4, the rotating member 19 is provided at the lower end of the holding portion 17, outside of the LED head 17*b*. In other words, the rotating member 19 is provided at an outer end outside the width of the sheet with respect to the axial direction of the photosensitive drum 8. A contacted portion 17*c* is located further toward the inner side of the apparatus than the rotating member 19 of the LED head 17*b* in the axial direction of the photosensitive drum 8. FIG. 4 only shows one side of a sheet width direction, but the other side has the same configuration as the one shown in FIG. 4 and is in a symmetrical shape.

Figure 5:
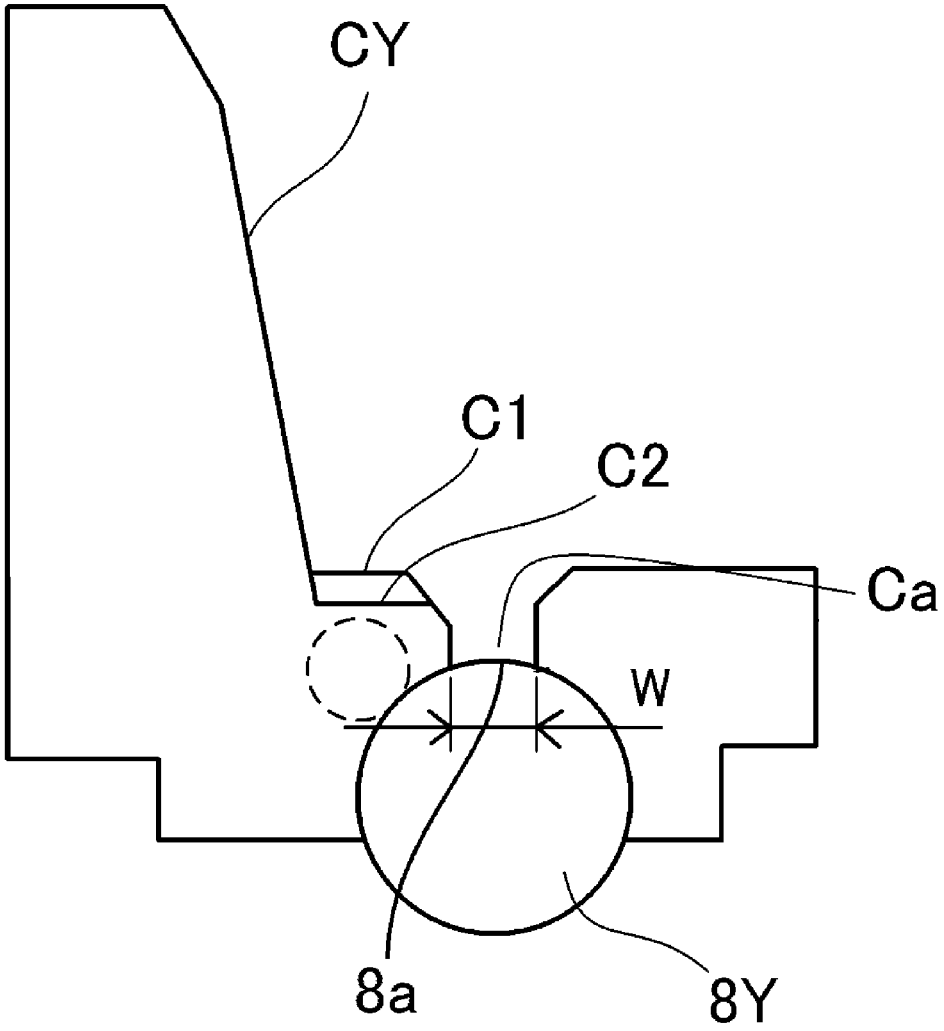
FIG. 5 is a schematic diagram showing a configuration of a cartridge.

FIG. 5 is a schematic diagram showing a configuration of one of the cartridges. As shown in FIG. 5, the cartridge C is provided with a groove Ca. A groove width W of the groove Ca is slightly wider than the width of the holding portion 17. By fitting the holding portion 17 into the groove Ca provided in the process cartridge C, the rotating member 19 comes into contact with the first contact portion 8*a* of the photosensitive drum 8, positioning the LED head 17*b* with respect to the photosensitive drum 8. The LED head 17*b* provided above the cartridge C outputs light emitted from the corresponding light-emitting element in response to image information on the corresponding color that is input from the external host device, not shown, to expose the photosensitive drum 8 of the cartridge C to the light.

Also, as shown in FIG. 1 and the like, an intermediate transfer belt unit (simply referred to as "belt unit," hereinafter) 22 is provided below the cartridge C. The belt unit 22 has a flexible endless belt (an intermediate transfer member) 11 made of a dielectric material, a driver roller 3 that cyclically moves the belt 11, and a tension roller 4. The photosensitive drum 8 of the cartridge C is in contact with the belt 11 at a lower surface of the photosensitive drum 8. Four primary transfer rollers (not shown) that face the photosensitive drums 8 with the belt 11 therebetween are provided on the inside of the belt 11. A secondary transfer roller 2 is in contact with the driver roller 3 with the belt 11 therebetween.

Sheet feeding means is provided below the belt unit 22. The sheet feeding means has a feed tray 10, feeding roller 1, and a separating roller 1*a*. A fixing apparatus 5 and a pair of discharge rollers 6 are provided in the back of an upper section of the main body of the apparatus M. An upper surface of the main body of the apparatus M configures a discharge tray 7.

When forming an image, an electrophotographic image forming process is executed to form a toner image on each of the photosensitive drums 8. Then, the toner images are primary-transferred successively to the cyclically moving belt 11. As a result, a full color toner image is formed on the belt 11. In synchronization with this image formation process, the sheet S, separated and fed, is conveyed by the feeding roller 1 and the separating roller 1*a* to a secondary transfer portion, a nip between the secondary transfer roller 2 and the belt 11. The toner image on the belt 11 is transferred onto the sheet S by a bias applied to the transfer roller 2. The sheet S having the toner image transferred thereto is conveyed to the fixing apparatus 5. The sheet S is then heated and pressurized to have the toner image fixed thereto by the fixing apparatus 5. Consequently, an image is formed on the sheet S. The sheet S with an image thereon is thereafter discharged to the discharge tray 7 by the pair of discharge rollers 6.

A configuration for attaching/detaching the cartridges C to/from the main body of the apparatus M is described next. The cartridge C (CY, CM, CC, CK) of Embodiment 1 is configured to be replaceable by a user. As described above, the LED units 15Y, 15M, 15C, 15K are axially supported with respect to the LED support member 14 so as to be rotatable about the respective shafts 21, as shown in FIG. 4. As shown in FIG. 1 and the like, a link 12 is configured to be able to swing about a joint portion 12*a*, and a joint 13 is configured to be able to swing about a joint portion 13*a*.

Figure 6:
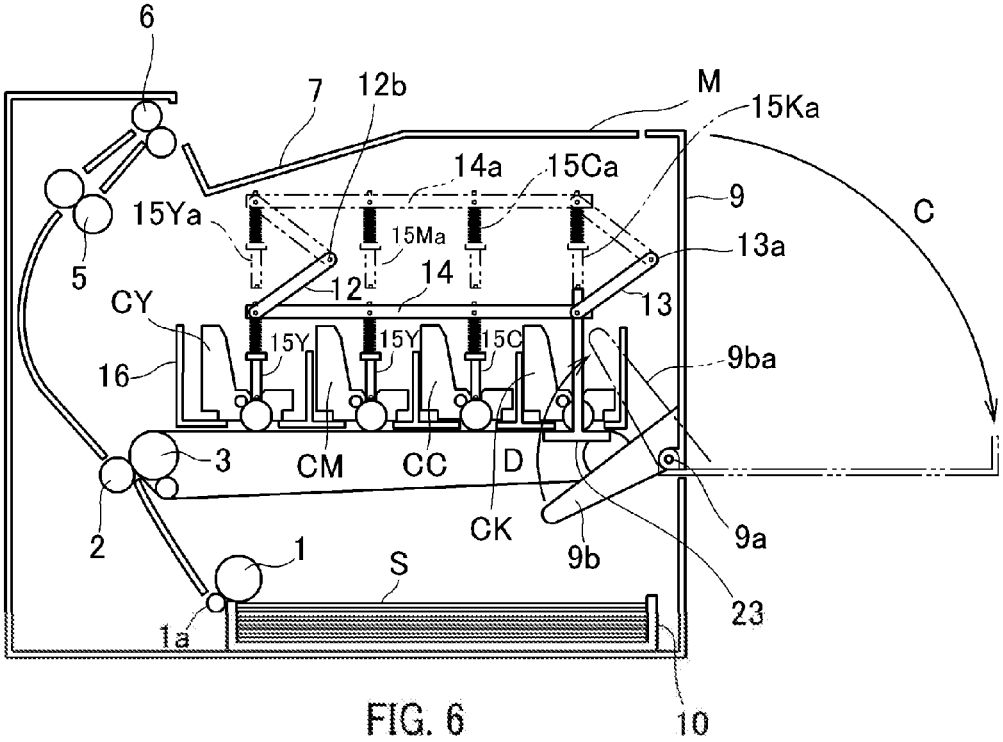
FIG. 6 is a diagram for explaining an operation for separating LED units by opening/closing a door.

FIG. 6 is a diagram for explaining an operation for separating the LED units by opening/closing the door. In FIG. 6, the two-dot chain lines each indicate the state of a form obtained as a result of the separation operation. As shown in FIG. 6, the door 9 is provided with a cam 9*b*, and a cam follower 23 is provided integrally with the LED support member 14. In order to replace the process cartridges CY, CM, CC, CK, the user opens the door 9 (moves the door 9 in the direction of the arrow C). Once the door 9 is open, the cam 9*b* lifts the cam follower 23 upward (moves the cam follower 23 in the direction of the arrow D).

This upward lifting of the cam follower 23 causes the links 12, 13 that swing about the joint portions 12*a*, 13*a* to bring the LED support member 14 up to a position 14*a* shown by a two-dot chain line. Subsequently, the LED units 15 are raised to positions 15Ya, 15Ma, 15Ca, 15Ka, respectively. In this state, the LED head 17*b* is in a third position where the first contact portion 8*a* and the rotating member 19 are separated from each other and a support portion (a second contact portion) C1 that is described later and the contacted portion 17*c* are separated from each other. In this manner, the tray 16 accommodating the cartridges CY, CM, CC, CK can be removed.

Figure 7:
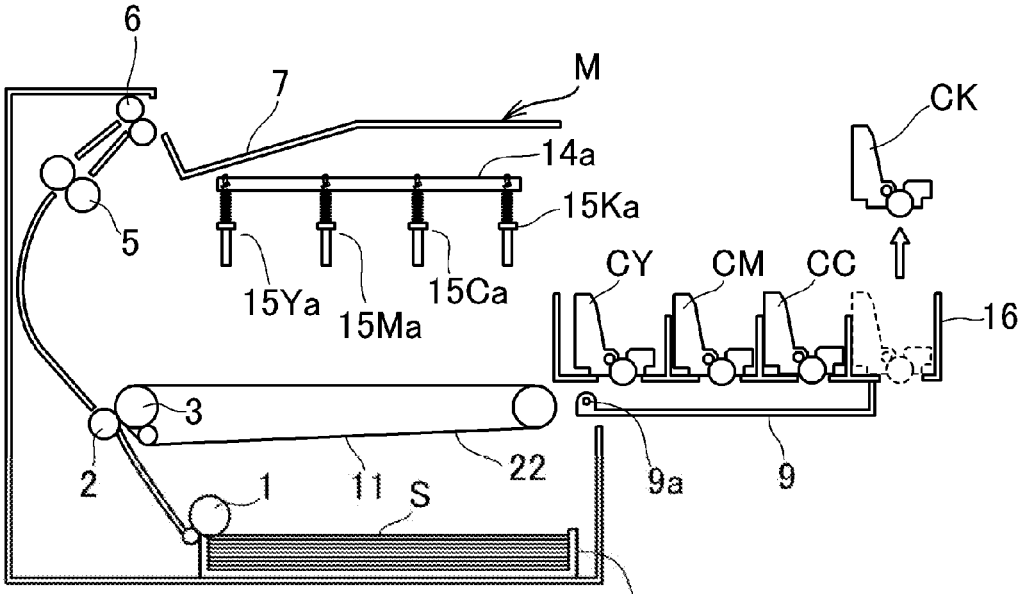
FIG. 7 is a diagram showing a state in which a tray accommodating cartridges is removed.

FIG. 7 is a diagram showing a state in which the tray 16 for accommodating the cartridges C is removed. As shown in FIG. 7, bringing the door 9 to the open position relative to the main body of the apparatus creates a state in which the LED units 15 escape the cartridges C and thereby the tray 16 can be pulled out. The tray 16 is guided to the outside of the main body of the apparatus M by a guide member, not shown. This enables replacement of the cartridges C if necessary. FIG. 7 shows the cartridge CK that is being replaced.

The configuration for attaching/detaching the cartridges C to/from the main body of the apparatus M is further described with reference to FIG. 6. After the cartridges C are replaced, the tray 16 is stored in the main body of the apparatus M, bringing the door 9 into the closed state. In this state the cam 9*b* returns to the solid line position thereof and the cam follower 23 is lowered. Consequently, the LED support member 14 is also lowered to the solid line position thereof. The configuration is further described with reference to FIG. 5. As shown in this figure, the mouth of the groove Ca for the container of the cartridge C is opened. The corresponding LED unit 15 is guided to the groove Ca as the door 9 closes, bringing the rotating member 19 of the LED unit 15 into contact with the photosensitive drum 8. As a result, the distance between the LED head 17*b* and the photosensitive drum 8 becomes a predetermined distance, leading to a state that enables image formation (printable state).

Figure 8:
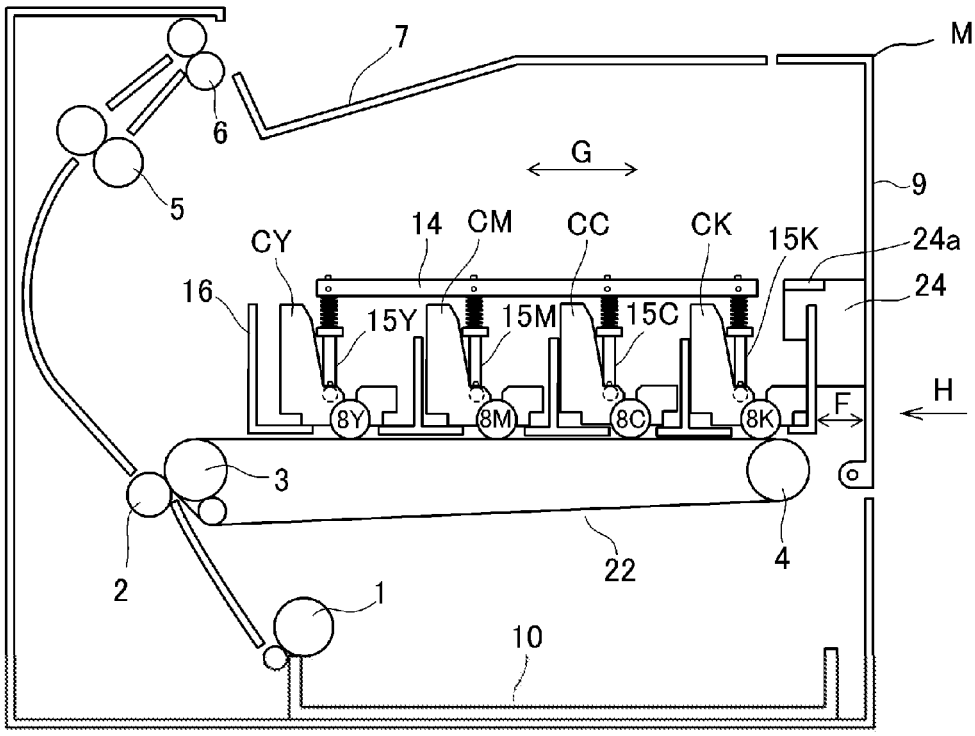
FIG. 8 is a schematic cross-sectional diagram showing the image forming apparatus in a transporting state according to Embodiment 1.

A state of transporting the image forming apparatus of Embodiment 1 is described next. FIG. 8 is a schematic cross-sectional diagram showing the image forming apparatus in a transporting state (a second state) according to Embodiment 1. In Embodiment 1, the second state means a state in which the image forming apparatus is transported, the door 9 is in the closed position relative to the main body of the apparatus, and the LED units 15 are supported by the cartridges C in such a way that the cartridges C and the rotating members 19 are separated from each other. As shown in FIG. 8, a shipping lock 24 functioning as a detachable member for fixing the tray 16 is attached at the time of transportation. The shipping lock 24 has a projection 24*a*, which is inserted in a hole formed in a side plate configuring the frame of the main body of the apparatus M and is positioned in the direction of pulling the tray 16 (the direction of the arrow G in FIG. 8). A distance F between the tray 16 and the door 9 with the shipping lock 24 of FIG. 8 attached is shorter than a distance E between the tray 16 and the door 9 shown in FIG. 1.

Figure 9:
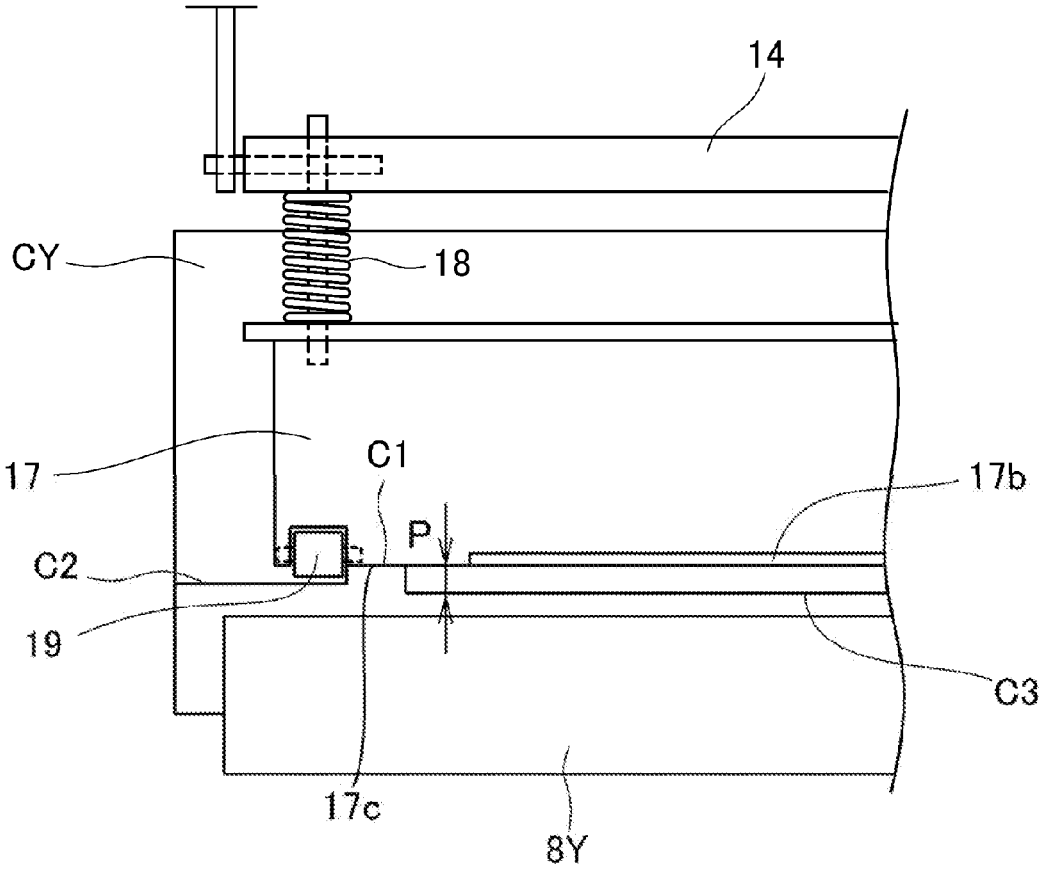
FIG. 9 is a diagram showing the LED units of FIG. 8 in a direction H.

As shown in FIG. 5, the frame body of the cartridge CY has the support portion C1 and a non-contacting portion C2 located below the support portion C1. The other cartridges have the same frame body. FIG. 9 is a diagram showing a state of the LED unit 15 in relation to the cartridge at the time of transportation of the image forming apparatus, the state being viewed from a direction H of FIG. 8. As shown in FIG. 9, the frame body of the cartridge CY also has a non-contacting portion C3 located below the support portion C1. At the time of transportation of the image forming apparatus, as shown in FIG. 9, the position (level) of the LED unit 15 is controlled by bringing the contacted portion 17*c* of the holding portion 17 into contact with the support portion (the second contact portion) C1 of the frame body of the cartridge C to support the contacted portion 17*c*. In this state, the rotating member 19 faces the non-contacting portion C2 and is not in contact with the first contact portion 8*a* which is a part of the cartridge C and with the frame body. On the other hand, the LED head 17*b* faces the non-contacting portion C3, is away from the frame body of the cartridge C by a distance P and is therefore not in contact with the cartridge C.

At the time of transportation of the image forming apparatus, i.e., in the second state, the spring 18 functioning as a biasing member biases the LED unit 15 with respect to the frame body of the cartridge C and is therefore kept compressed more than it is when the image forming apparatus is used (when printing is performed). In other words, the spring 18 biases the LED head 17*b* in the direction in which the contacted portion 17*c* is pressed against the support portion (the second contact portion) C1. After purchasing the image forming apparatus, the user opens the package (not shown) containing the image forming apparatus, opens the door 9 to let the LED units 15 (Y, M, C, K) escape the respective cartridges, removes the shipping lock 24, and then install the tray 16 in its regular position (pushes the tray 16 into main body of the apparatus). The LED units 15 come into contact with the respective photosensitive drums (8Y, 8M, 8C, 8K) by closing the door 9, creating the printable state (the first state). According to Embodiment 1, the first state is the closed state of the door 9 at the time of image formation (printing), in which each cartridge C is in contact with the rotating member 19 and the LED head 17*b* is positioned in the first position with respect to the photosensitive drum 8. At the time of transportation (shipping), the shipping lock 24 is installed and then the door 9 is closed, creating the transporting state (the second state) shown in FIG. 8. In this state, the LED head 17*b* is positioned in the second position.

Figure 10:
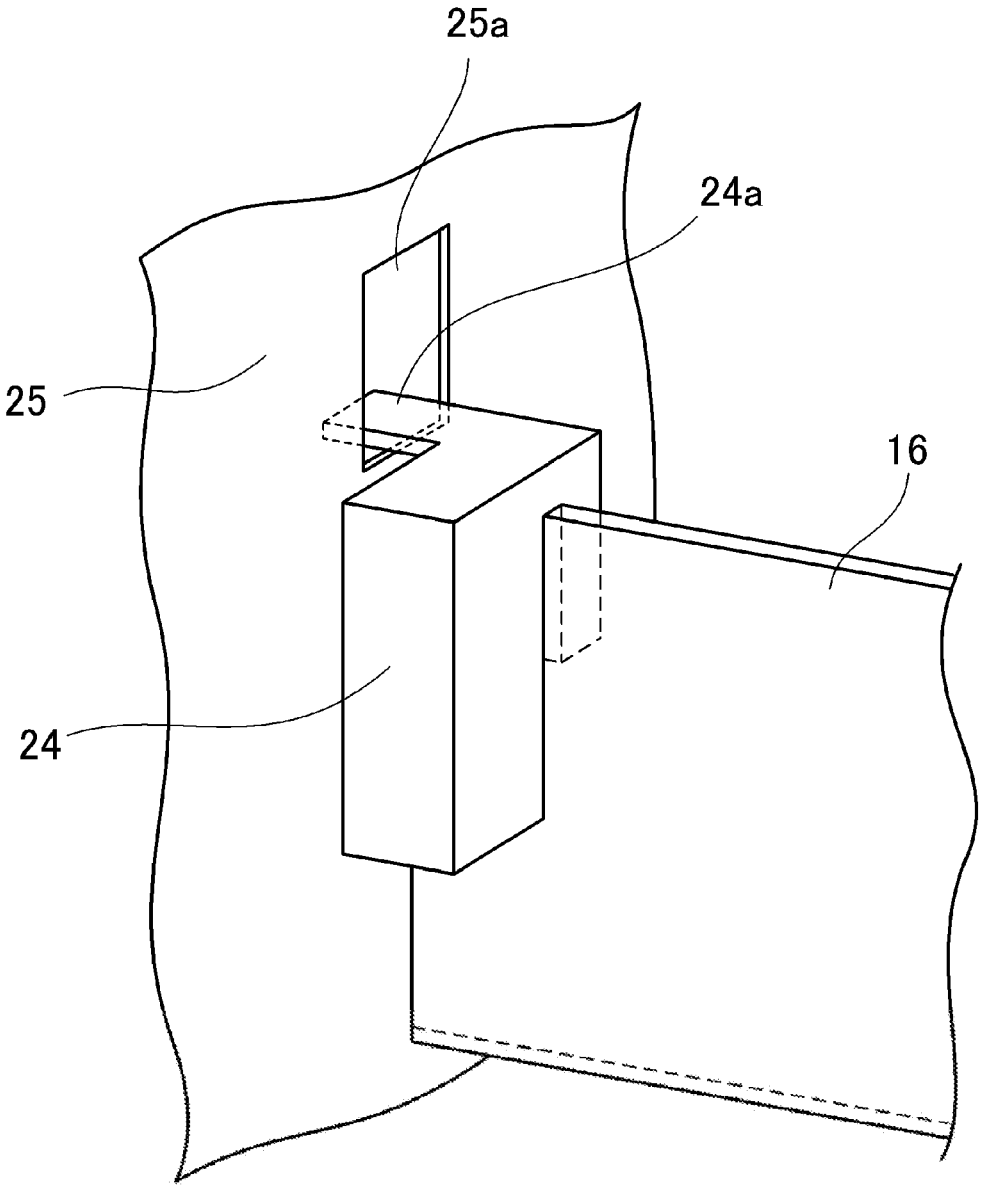
FIG. 10 is a perspective view showing the installed state of a shipping lock.

FIG. 10 is a perspective view showing the installed state of the shipping lock. A side plate 25 configuring the frame of the main body of the apparatus M is provided with a hole 25*a*. The projection 24*a* of the shipping lock 24 is inserted into the hole 25*a* of the side plate 25, determining the direction of pulling out the tray 16 (the direction of the arrow G). The relative position between the LED unit 15 and the corresponding cartridge C is determined by positioning the tray 16 in this manner. When the shipping lock 24 functioning as a detachable member is installed in the main body of the apparatus M, the movements of the tray 16 are regulated and thereby the tray 16 is positioned to create the second state described above. Regulating the movements of the tray 16 regulates the position of the cartridge C, keeping the LED head 17*b* in the second position. FIG. 10 only shows the state of one side of the sheet width direction, but the other side shares the same configuration.

According to Embodiment 1 as described above, keeping the rotating members 19 away from the cartridge C at the time of transportation of the image forming apparatus can prevent damage to the rotating members 19 by vibration and the like of the transportation. Furthermore, according to Embodiment 1, because the LED units 15 are not in contact with the photosensitive drums 8 at the time of transportation of the image forming apparatus, the photosensitive drums 8 can be prevented from being damaged by vibration and the like of the transportation. The fact that the rotating members 19 functioning as positioning portions and photosensitive drums 8 can be prevented from damage can curb the impact of damage of the rotating members 19 and photosensitive drums 8 on an image to be formed. Because the springs 18 bias the LED units 15 with respect to the cartridges C at the time of transportation of the image forming apparatus, the positions of the LED units 15 can be fixed, preventing the LED units 15 from impact and damage by vibration and the like of the transportation.

The above has described Embodiment 1 in which each rotating member 19 comes into direct contact with the corresponding photosensitive drum 8 to position the LED head 17*b* with respect to the photosensitive drum 8, but the present invention is not limited to this configuration. A configuration is possible in which, for example, the LED head 17*b* is positioned with respect to the photosensitive drum 8 by bringing the rotating member 19 into contact with the frame body of the cartridge C.

Embodiment 2

Embodiment 2 is described next with reference to FIGS. 11 to 19. Note that the same reference numerals are applied to the components same as those of Embodiment 1. An operation for forming an image according to Embodiment 2 is same as the one described in Embodiment 1; thus, the description thereof is omitted accordingly.

Figure 11:
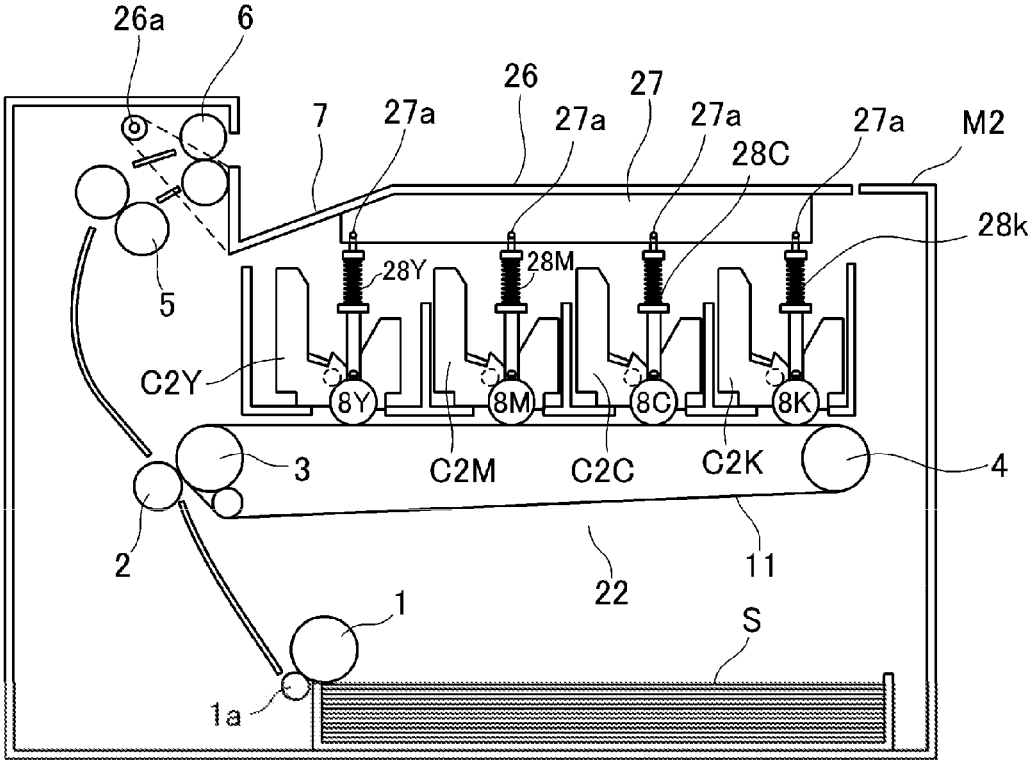
FIG. 11 is a schematic cross-sectional diagram showing the entire configuration of an image forming apparatus according to Embodiment 2.

First of all, a schematic configuration of an image forming apparatus according to Embodiment 2 is described. FIG. 11 is a schematic cross-sectional diagram showing a schematic configuration of the image forming apparatus according to Embodiment 2. The image forming apparatus according to Embodiment 2 has cartridges C that can be attached/detached to/from a main body of the apparatus M2 when an upper cover 26 provided in an upper surface of the main body of the apparatus M2 and functioning as a door is open.

As with Embodiment 1, the image forming apparatus according to Embodiment 2 is an LED printer with four full colors that employs an electrophotographic image forming process. This printer forms an image on a sheet S (a recording medium) based on an image signal that is input from an external host apparatus (not shown) such as a personal computer or an image reader. In addition, as with Embodiment 1, the image forming apparatus of Embodiment 2 has four cartridges C2 (C2Y, C2M, C2C, C2K) with photosensitive drums 8 (8Y, 8M, 8C, 8K), and LED units 28 (28Y, 28M, 28C, 28K) corresponding to these cartridges.

The upper surface of the main body of the apparatus M2 is provided with the upper cover 26 that functions as a door rotatable about a point of support 26*a*. The LED units 28 (28Y, 28M, 28C, 28K) are each supported swingably by a support portion 27*a* of a rib 27 provided in the upper cover 26.

Figure 12:
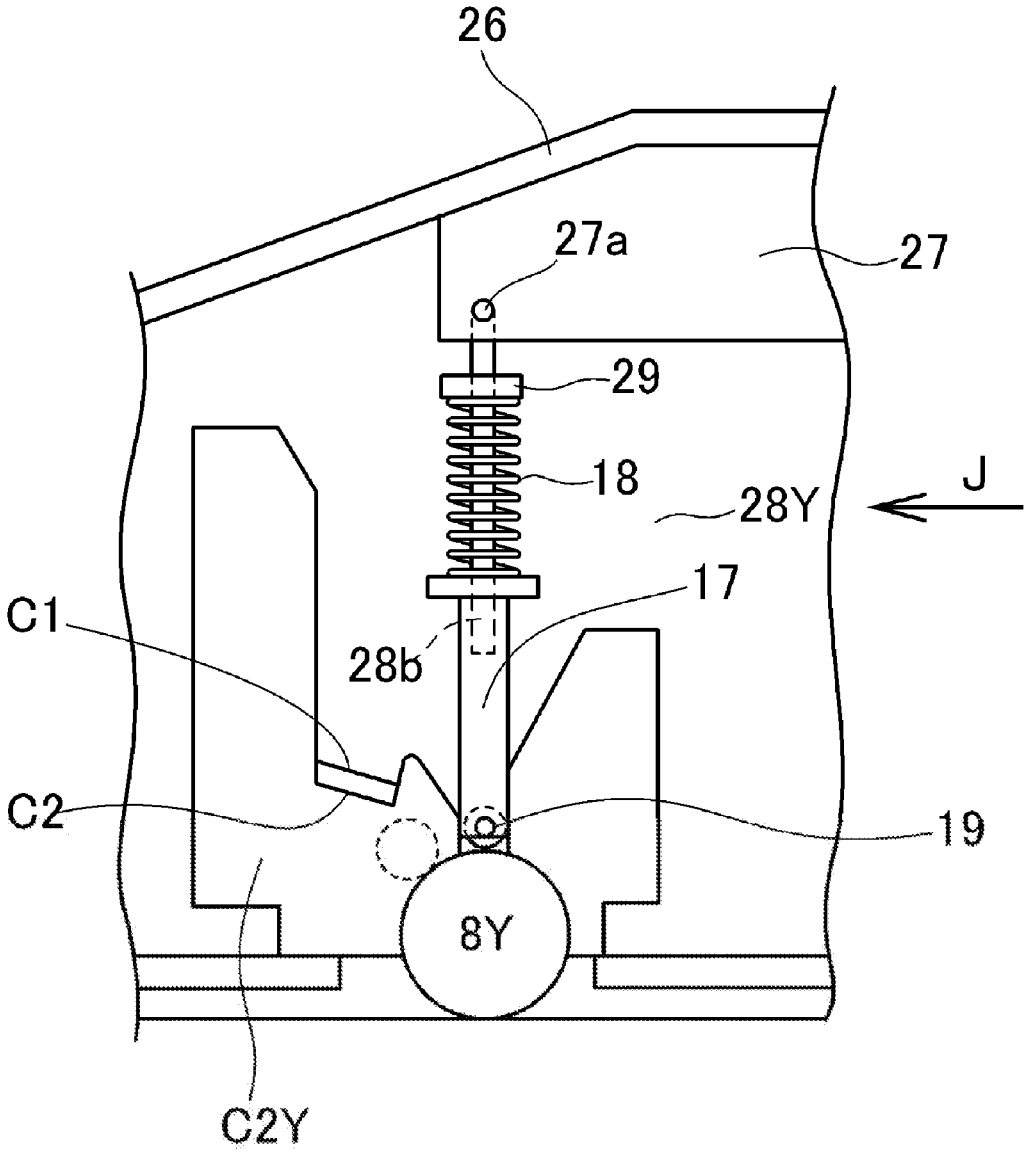
FIG. 12 is an enlarged view showing a state in which a photosensitive drum and an LED head are in contact with each other.
Figure 13:
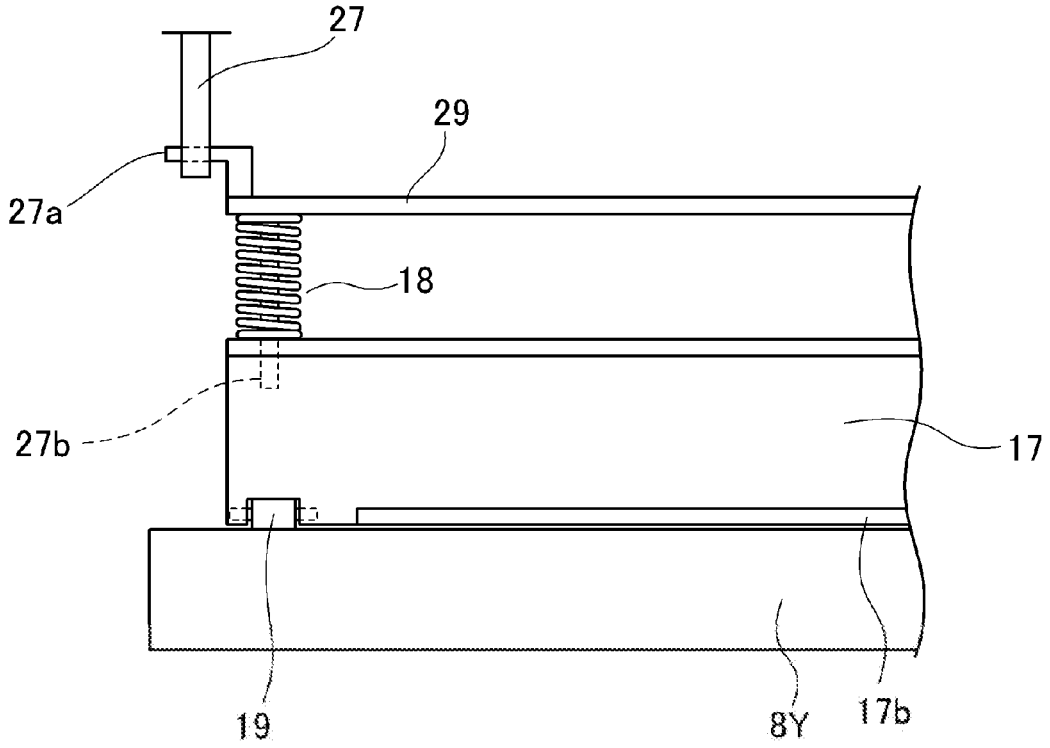
FIG. 13 is a diagram showing an LED unit of FIG. 12 in the direction of the arrow J.

FIG. 12 is a diagram showing a state in which a rotating member of Embodiment 2 is in contact with the corresponding photosensitive drum. FIG. 13 is a diagram showing the LED unit of FIG. 12 in the direction of the arrow J. The LED units 28 each have an LED head 17*b* functioning as an exposure device, a holding portion 17 retaining the LED head 17*b*, and a rotating member 19 functioning as a positioning portion for positioning the LED head 17*b* with respect to the corresponding photosensitive drum 8.

Furthermore, the LED units 28 each have, at its one end in the vertical direction, an engagement portion 27*b* that comes into engagement with the holding portion 17 and, at the other end, an LED support member 29 supported swingably with respect to the rib 27. The LED support member 29 is provided with a spring 18 functioning as a biasing member, and by applying pressure to the holding portion 17 with the spring 18, the rotating member 19 provided at a lower end of the holding portion 17 is brought into contact with the photosensitive drum 8. Such a configuration keeps the distance between the LED head 17*b* and the photosensitive drum 8 at a practical value. As with Embodiment 1, the frame bodies of the cartridges C2 each have a support portion C1.

Figure 14:
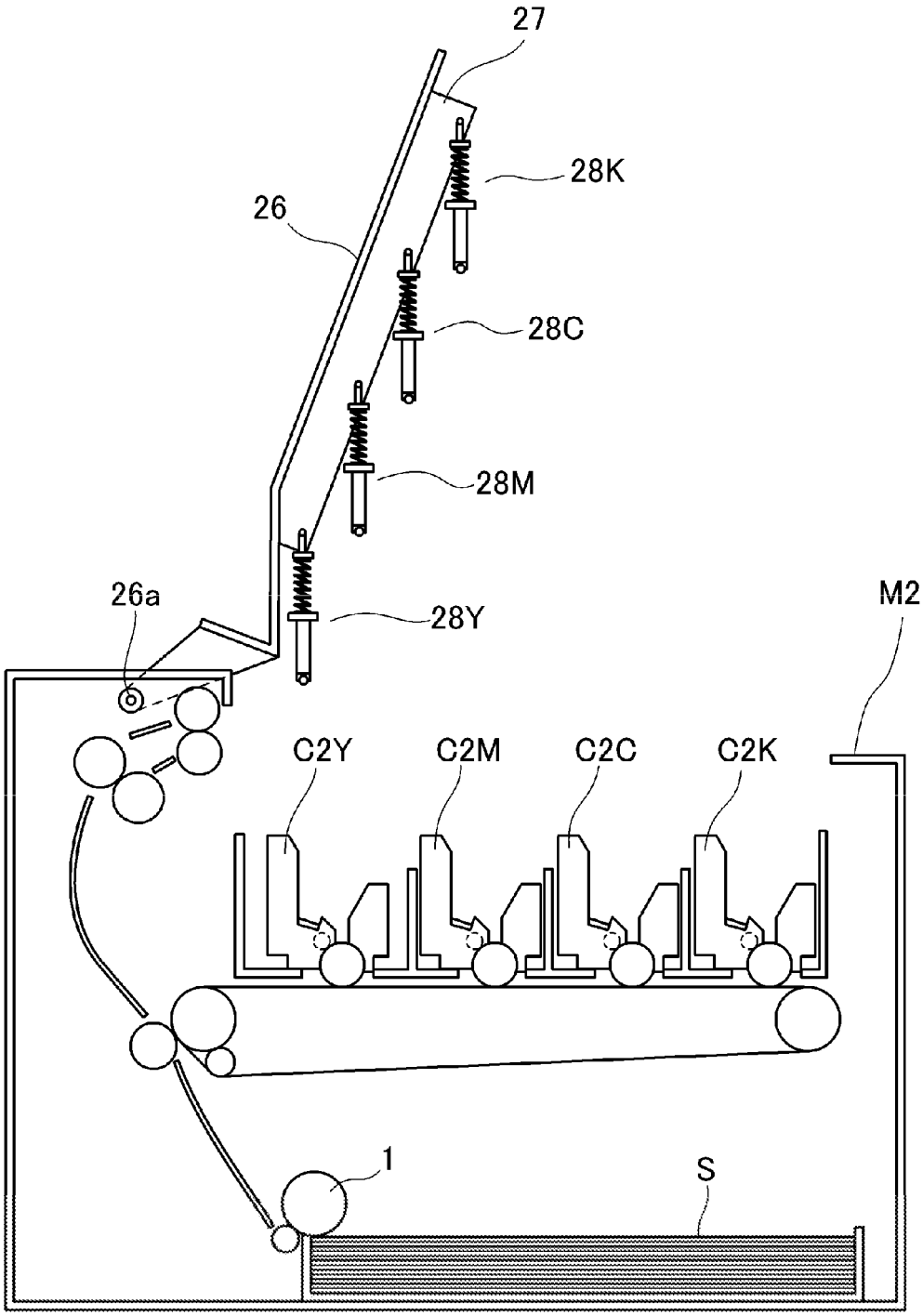
FIG. 14 is a diagram showing the open state of an upper cover.

FIG. 14 is a diagram showing a state in which the upper cover 26 is opened for the purpose of removing the cartridges C2 from the main body of the apparatus M2. As shown in FIG. 14, when the upper cover 26 is open, the LED unit 28 (28Y, 28M, 28C, 28K) is stopped by its own weight, with the LED head 17*b* facing downward. With the upper cover 26 opened, the cartridges C2 can be removed from above and replaced, if necessary.

Figure 15:
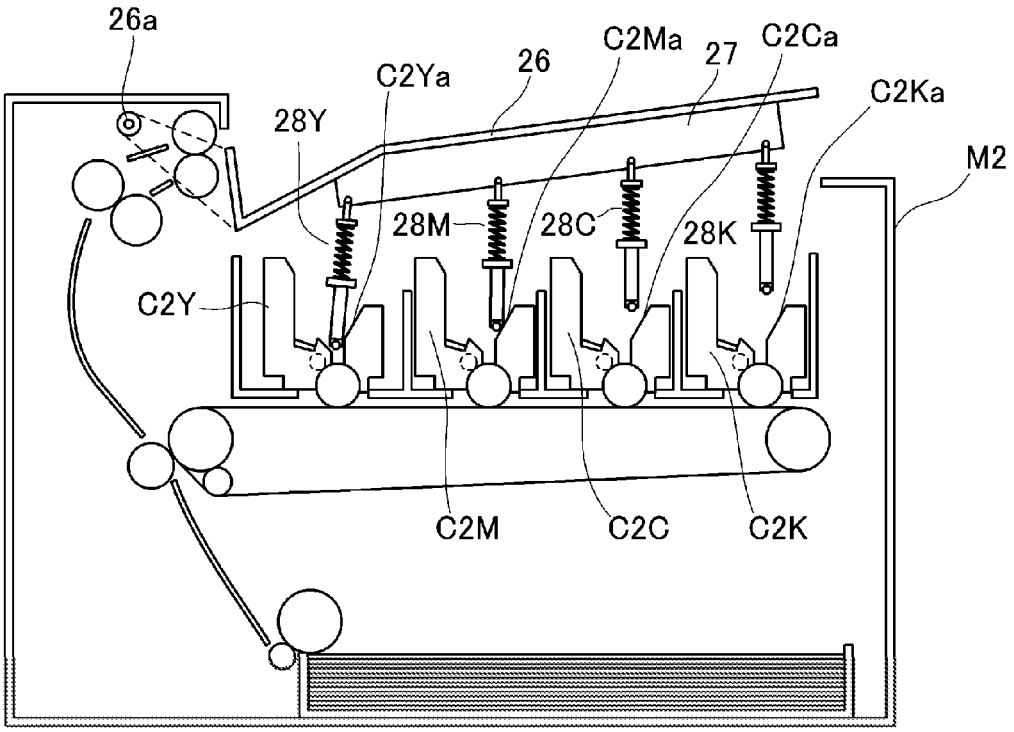
FIG. 15 is a diagram showing a state in which the upper cover is about to be closed.

FIG. 15 is a diagram showing a state in which the upper cover 26 is about to be closed after the cartridges C2 are replaced. As shown in FIG. 15, the LED unit 28 (28Y, 28M, 28C, 28K) is guided along an inclined surface C2*a* (C2Ya, C2Ma, C2Ca, C2Ka) provided in the cartridge C2 (C2Y, C2M, C2C, C2K). As with Embodiment 1, the holding portion 17 is fitted into the groove of the cartridge C2 (C2Y, C2M, C2C, C2K), positioning the LED unit 28 with respect to the cartridge C2. As a result, a printable state (a first state) shown in FIG. 11 is accomplished.

Figure 16:
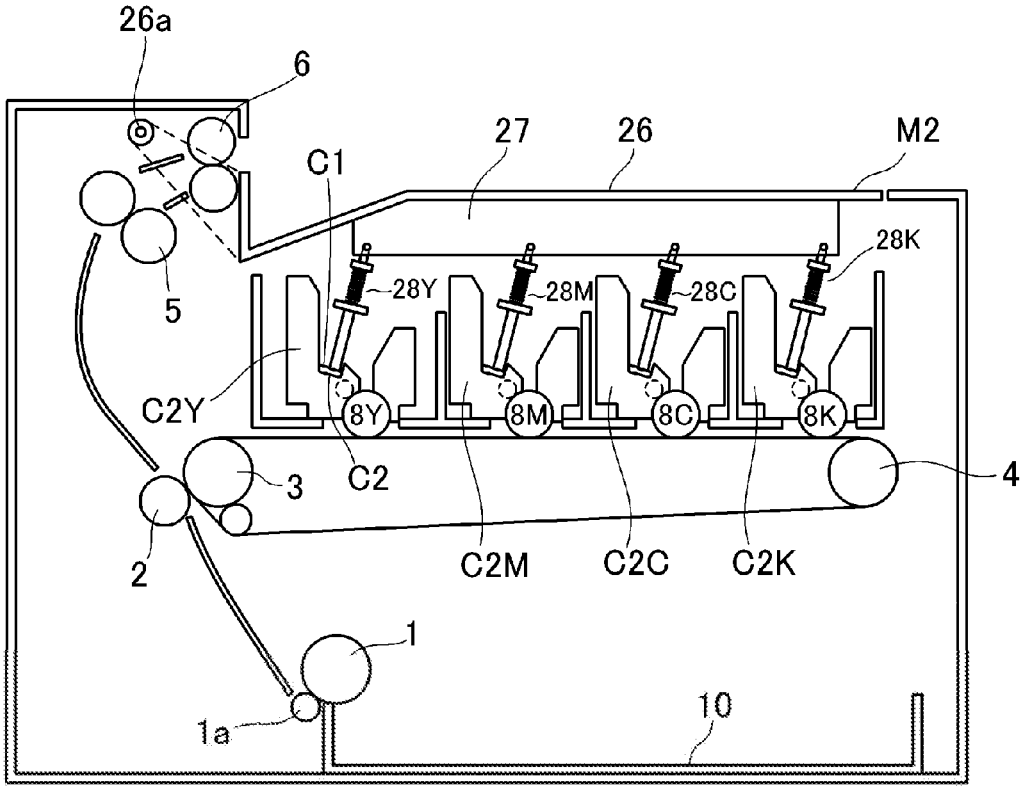
FIG. 16 is a diagram showing the image forming apparatus in a transporting state according to Embodiment 2.

A state of transporting the image forming apparatus (a second state) is described next. FIG. 16 is a diagram showing the image forming apparatus in the transporting state according to Embodiment 2. According to Embodiment 2, when transporting the image forming apparatus, because the LED unit 28 is tilted, the holding portion 17 of the LED unit 28 comes into contact with the support portion C1 of the cartridge C2, whereas the rotating member 19 faces the non-contacting portion C2 and is not in contact with the frame of the cartridge C2. In this transporting state, the spring 18 functioning as a biasing member presses the LED unit 28 against the cartridge C2 and is therefore compressed more than it is when printing is performed, hence the higher applied pressure.

Figure 17:
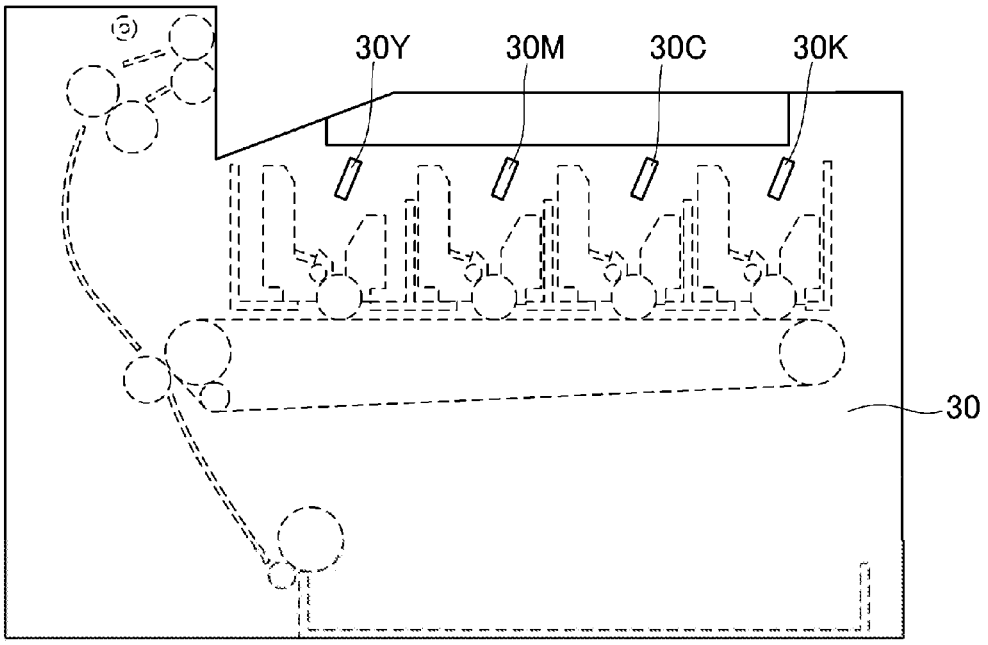
FIG. 17 is a diagram showing aside plate configuring the frame of the image forming apparatus.

A step of assembling the image forming apparatus of Embodiment 2 in a transportable manner is described next. FIG. 17 is a diagram showing a side plate configuring the frame of the image forming apparatus. The broken lines mean that the inside of the image forming apparatus is seen through from one side. As shown in FIG. 17, a side plate 30 configuring the frame of the main body of the apparatus M2 is provided with four square holes 30Y, 30M, 30C, 30K. In Embodiment 2, an assembly tool 31 functioning as a detachable member is installed in each of the square holes 30Y, 30M, 30C, 30K, thereby guiding and displacing the LED unit 28 in relation to the cartridge C2 to accomplish the second state. The second state is the transporting state in which the LED unit 28 is supported by the support portion C1 of the cartridge C2 in such a manner that the cartridge C2 and the rotating member 19 are separated from each other.

Figure 18:
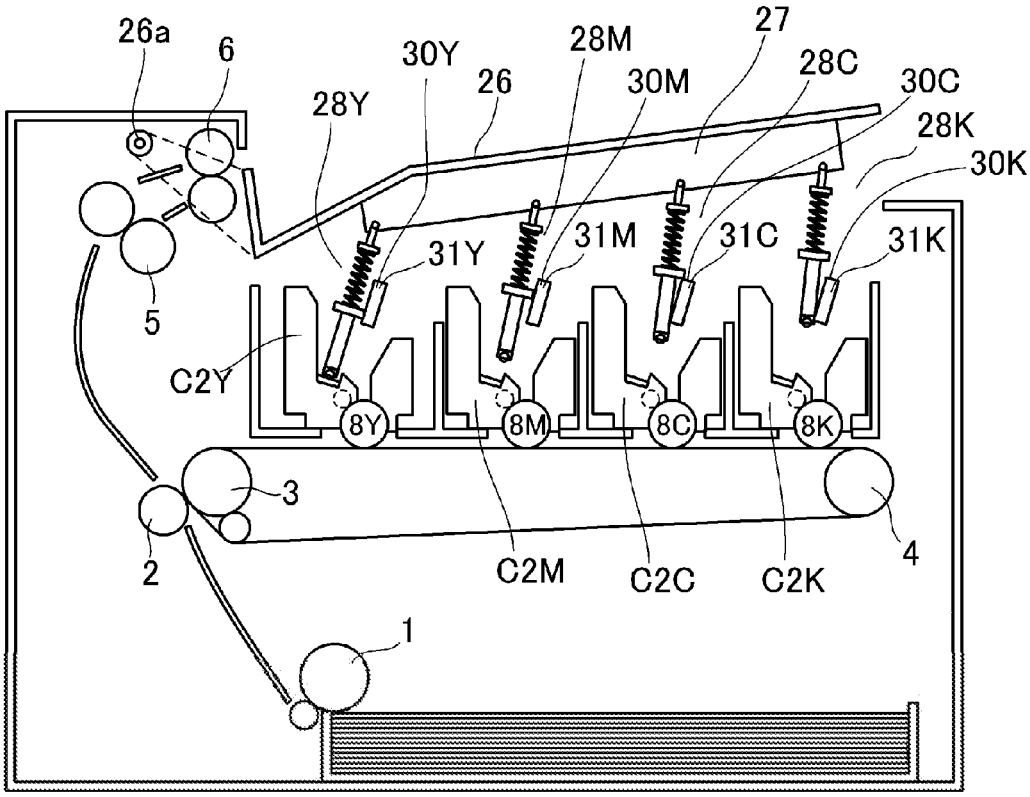
FIG. 18 is a diagram showing a state in which the upper cover is about to be closed, with assembly tools being attached.
Figure 19:
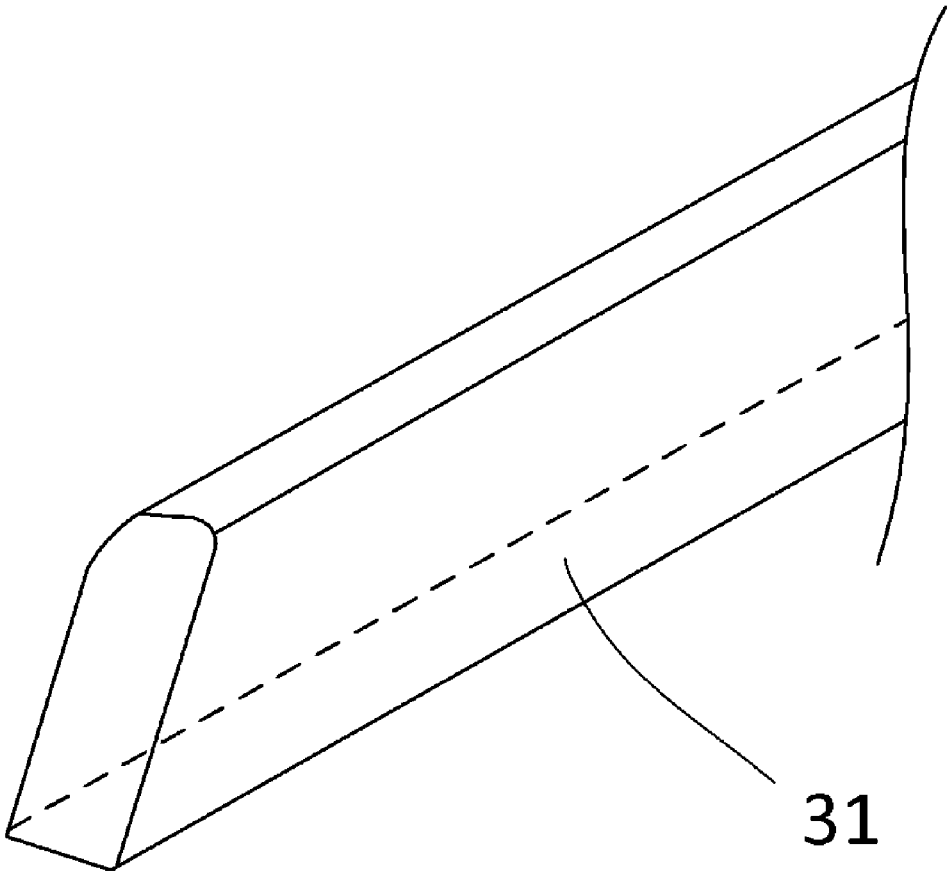
FIG. 19 is a perspective view of one of the assembly tools.

FIG. 18 is a diagram showing a state in which the upper cover is about to be closed, with the assembly tools being attached. FIG. 19 is a perspective view of one of the assembly tools. The upper cover 26 provided with the LED units 28 is closed, with the assembly tools 31 (31Y, 31M, 31C, 31K) inserted into the square holes 30Y, 30M, 30C, 30K. The LED units 28 are tilted by the assembly tools 31, creating the state shown in FIG. 16 in which the image forming apparatus can be transported.

Embodiment 2 can achieve the same effects as those of Embodiment 1 by employing the foregoing configurations. Not only is it possible to achieve the effects of Embodiment 1, but also the image forming apparatus of the present invention can be converted from the transportable state to the printable state by simply allowing the user to open/close the upper cover 26, so the trouble of removing packaging materials can be avoided.

Among the printers functioning as image forming apparatuses is a printer that is provided with replaceable cartridges having memories (IC chips), wherein the information stored in the memories are read by the main body of the apparatus and reflected in controlling a print operation. Such a printer may have the configurations of Embodiments 1, 2, in which the readers provided in the main body of the apparatus are equipped in the LED units. In this case, the readers in the main body are provided with support portions so as not to come into contact with the frame bodies of the cartridges C at the time of transportation. Such a configuration can prevent the readers from damage by contact with the cartridges C1, the damage being possible due to vibration of the transportation. Moreover, it only takes a simple operation to position the LED units in the printable positions, enabling easy connection of the readers. In addition to such readers, the present example may employ a configuration that has an information communication unit or the like capable of writing information in each cartridge.

Although the foregoing LED head 17*b* functioning as an exposure unit has a plurality of light-emitting diodes, an exposure unit that uses light-emitting elements such as organic EL light-emitting elements instead of the light-emitting diodes may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-179049, filed Sep. 3, 2014, and Japanese Patent Application No. 2015-146166, filed Jul. 23, 2015, which are hereby incorporated by reference herein in their entirety.

What is claimed is:

1. An image forming apparatus, comprising:

a cartridge that can be attached/detached to/from a main body of the apparatus, a photosensitive member provided in the cartridge;

an exposure unit that exposes the photosensitive member to light;

a first contact portion disposed in the cartridge;

a positioning portion provided in the exposure unit, the positioning portion coming into contact with the first contact portion to position the exposure unit in a first position where the photosensitive member is exposed to light;

a second contact portion disposed in a frame body of the cartridge which includes a guiding portion guiding movement of the exposure unit such that the positioning portion comes into contact with the first contact portion; and a contacted portion that is provided in the exposure unit, wherein the contacted portion is brought into contact with the second contact portion, thereby positioning the exposure unit in a second position where the positioning portion and the first contact portion are separated from each other.

2. The image forming apparatus according to claim 1, wherein the exposure unit can be moved to a third position where the positioning portion is separated from the first contact portion and the contacted portion is separated from the second contact portion.

3. The image forming apparatus according to claim 2, further comprising:

an opening/closing member that is openable/closable relative to the main body of the apparatus, wherein when the opening/closing member is in a closed position relative to the main body of the apparatus, the exposure unit is located in the first or second position, and when the opening/closing member is in an open position relative to the main body of the apparatus, the exposure unit is located in the third position.

4. The image forming apparatus according to claim 3, wherein when the opening/closing member is in the open position, the cartridge can be attached/detached to/from the main body of the apparatus.

5. The image forming apparatus according to claim 3, wherein the exposure unit is supported by the opening/closing member.

6. The image forming apparatus according to claim 1, further comprising:

a regulating member removable from the main body of the apparatus, wherein the contacted portion is kept in contact with the second contact portion by the regulating member regulating the position of the cartridge.

7. The image forming apparatus according to claim 6, further comprising:

a tray that is capable of moving with respect to the main body of the apparatus and accommodates the cartridge, wherein the regulating member regulates the position of the cartridge by regulating a movement of the tray.

8. The image forming apparatus according to claim 1, further comprising:

a biasing member that biases the exposure unit in a direction of pressing the positioning portion against the first contact portion, when the exposure unit is located in the first position.

9. The image forming apparatus according to claim 8, wherein the biasing member biases the exposure unit in a direction of pressing the contacted portion against the second contact portion, when the exposure unit is located in the second position.

10. An image forming apparatus, comprising:

a cartridge that can be attached/detached to/from a main body of the apparatus, a tray that is capable of moving with respect to the main body of the apparatus and accommodates the cartridge, a photosensitive member provided in the cartridge;

an exposure unit that exposes the photosensitive member to light;

a first contact portion provided in the cartridge;

a positioning portion provided in the exposure unit, the positioning portion coming into contact with the first contact portion to position the exposure unit in a first position where the photosensitive member is exposed to light;

a second contact portion;

a contacted portion that is provided in the exposure unit;

a regulating member removable from the main body of the apparatus, wherein the contacted portion is brought into contact with the second contact portion, thereby positioning the exposure unit in a second position where the positioning portion and the first contact portion are separated from each other, wherein the contacted portion is kept in contact with the second contact portion by the regulating member regulating the position of the cartridge, and wherein the regulating member regulates the position of the cartridge by regulating a movement of the tray.

11. The image forming apparatus according to claim 10, wherein the exposure unit can be moved to a third position where the positioning portion is separated from the first contact portion and the contacted portion is separated from the second contact portion.

12. The image forming apparatus according to claim 11, wherein the second contact portion is disposed in the cartridge.

13. The image forming apparatus according to claim 10, further comprising:

an opening/closing member that is openable/closable relative to the main body of the apparatus, wherein when the opening/closing member is in a closed position relative to the main body of the apparatus, the exposure unit is located in the first or second position, and when the opening/closing member is in an open position relative to the main body of the apparatus, the exposure unit is located in the third position.

14. The image forming apparatus according to claim 13, wherein when the opening/closing member is in the open position, the cartridge can be attached/detached to/from the main body of the apparatus.

15. The image forming apparatus according to claim 13, wherein the exposure unit is supported by the opening/closing member.

16. The image forming apparatus according to claim 10, further comprising:

a biasing member that biases the exposure unit in a direction of pressing the positioning portion against the first contact portion, when the exposure unit is located in the first position.

17. The image forming apparatus according to claim 16, wherein the biasing member biases the exposure unit in a direction of pressing the contacted portion against the second contact portion, when the exposure unit is located in the second position.

* * * * *